US010665943B2

(12) United States Patent
Yen et al.

(10) Patent No.: US 10,665,943 B2
(45) Date of Patent: May 26, 2020

(54) MOBILE DEVICES WITH INTEGRATED SLOT ANTENNAS

(71) Applicant: Acer Incorporated, New Taipei (TW)

(72) Inventors: Ming-Ching Yen, New Taipei (TW); Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 380 days.

(21) Appl. No.: 15/784,245

(22) Filed: Oct. 16, 2017

(65) Prior Publication Data

US 2018/0351254 A1 Dec. 6, 2018

(30) Foreign Application Priority Data

Jun. 5, 2017 (TW) ..... 106118500 A

(51) Int. Cl.

| | |
|---|---|
| ***H01Q 13/10*** | (2006.01) |
| ***H01Q 5/371*** | (2015.01) |
| ***H01Q 21/06*** | (2006.01) |
| ***H01Q 5/364*** | (2015.01) |
| ***H01Q 21/30*** | (2006.01) |

(Continued)

(52) U.S. Cl.

CPC ..... *H01Q 5/371* (2015.01); *H01Q 5/364* (2015.01); *H01Q 5/378* (2015.01); *H01Q 13/10* (2013.01); *H01Q 21/064* (2013.01); *H01Q 21/30* (2013.01); *H01Q 1/2266* (2013.01); *H01Q 1/243* (2013.01)

(58) Field of Classification Search

CPC ..... H01Q 5/371; H01Q 5/364; H01Q 5/378; H01Q 13/10; H01Q 21/064; H01Q 21/30; H01Q 1/2266; H01Q 1/243

See application file for complete search history.

(56) References Cited

U.S. PATENT DOCUMENTS 6,339,400 B1 1/2002 Flint et al.
9,502,775 B1 * 11/2016 Gummalla ..... H01Q 13/10

(Continued)

FOREIGN PATENT DOCUMENTS

| | | |
|---|---|---|
| TW | 201703350 A | 1/2017 |
| TW | 201703350 A | 2/2017 |
| TW | 201705610 A | 2/2017 |

OTHER PUBLICATIONS

Chinese language office action dated Jul. 17, 2018, issued in application No. TW 106118500.

*Primary Examiner* — Dameon E Levi
*Assistant Examiner* — David E Lotter
(74) *Attorney, Agent, or Firm* — McClure, Qualey & Rodack, LLP

(57) ABSTRACT

Mobile devices with integrated slot antennas are provided are provided. A representative mobile device includes: an exterior housing having a front and a back and defining an interior; a display, mounted to the housing, configured to display images at the front of the housing; and an antenna structure positioned within the interior; the housing having a first portion and a second portion, each of which is formed of metal, the first portion being located at the back of the housing and defining a first slot such that the antenna structure and the first slot form a first slot antenna, the second portion being located at the front of the housing and defining a second slot such that the antenna structure and the second slot form a second slot antenna.

21 Claims, 10 Drawing Sheets

(51) Int. Cl.

| | |
|---|---|
| ***H01Q 5/378*** | (2015.01) |
| *H01Q 1/24* | (2006.01) |
| *H01Q 1/22* | (2006.01) |

(56) References Cited

U.S. PATENT DOCUMENTS

| | | | | |
|---|---|---|---|---|
| 2014/0315509 | A1 | 10/2014 | Chang et al. | |
| 2015/0255853 | A1 | 9/2015 | Kwong et al. | |
| 2018/0219296 | A1* | 8/2018 | Chi | H01Q 1/243 |

* cited by examiner

MOBILE DEVICES WITH INTEGRATED SLOT ANTENNAS

CROSS REFERENCE TO RELATED APPLICATION

This utility application claims the benefit of and priority to Taiwan application 106118500, filed on Jun. 5, 2017, the entirety of which is incorporated herein by reference.

BACKGROUND

Technical Field

The disclosure relates to the use of slot antennas with mobile devices.

Description of the Related Art

Mobile devices (such as portable computers, mobile phones, and multimedia players, for example) have become increasingly common in recent years owing to developments in mobile communication technology. Specifically, mobile devices tend to incorporate significant wireless communication capabilities. Some include long-range wireless communications capabilities, such as those provided by 2G, 3G and LTE systems and use of 700 MHz, 850 MHz, 900 MHz, 1800 MHz, 1900 MHz, 2100 MHz, 2300 MHz and 2500 MHz frequency bands. Others include short-range wireless communications capabilities, such as those provided by Bluetooth and Wi-Fi systems and use of 2.4 GHz, 5.2 GHz and 5.8 GHz frequency bands.

In order to improve aesthetics, designers often add metal components to mobile devices. However, such metal components are likely to have a negative impact on the performance of antennas incorporated into the mobile devices, thereby reducing the overall communication quality of the mobile devices. Therefore, it is desired to provide mobile devices and associated antenna structures to overcome the problems presented by conventional technology.

SUMMARY

Mobile devices with integrated slot antennas are provided. In this regard, an example embodiment of a mobile device comprises: an exterior housing having a front and a back and defining an interior; a display, mounted to the housing, configured to display images at the front of the housing; and an antenna structure positioned within the interior; the housing having a first portion and a second portion, each of which is formed of metal, the first portion being located at the back of the housing and defining a first slot such that the antenna structure and the first slot form a first slot antenna, the second portion being located at the front of the housing and defining a second slot such that the antenna structure and the second slot form a second slot antenna.

Other features and/or advantages will become apparent from the following detailed description of the preferred but non-limiting embodiments. The following description is made with reference to the accompanying drawings.

DETAILED DESCRIPTION

Figure 1:
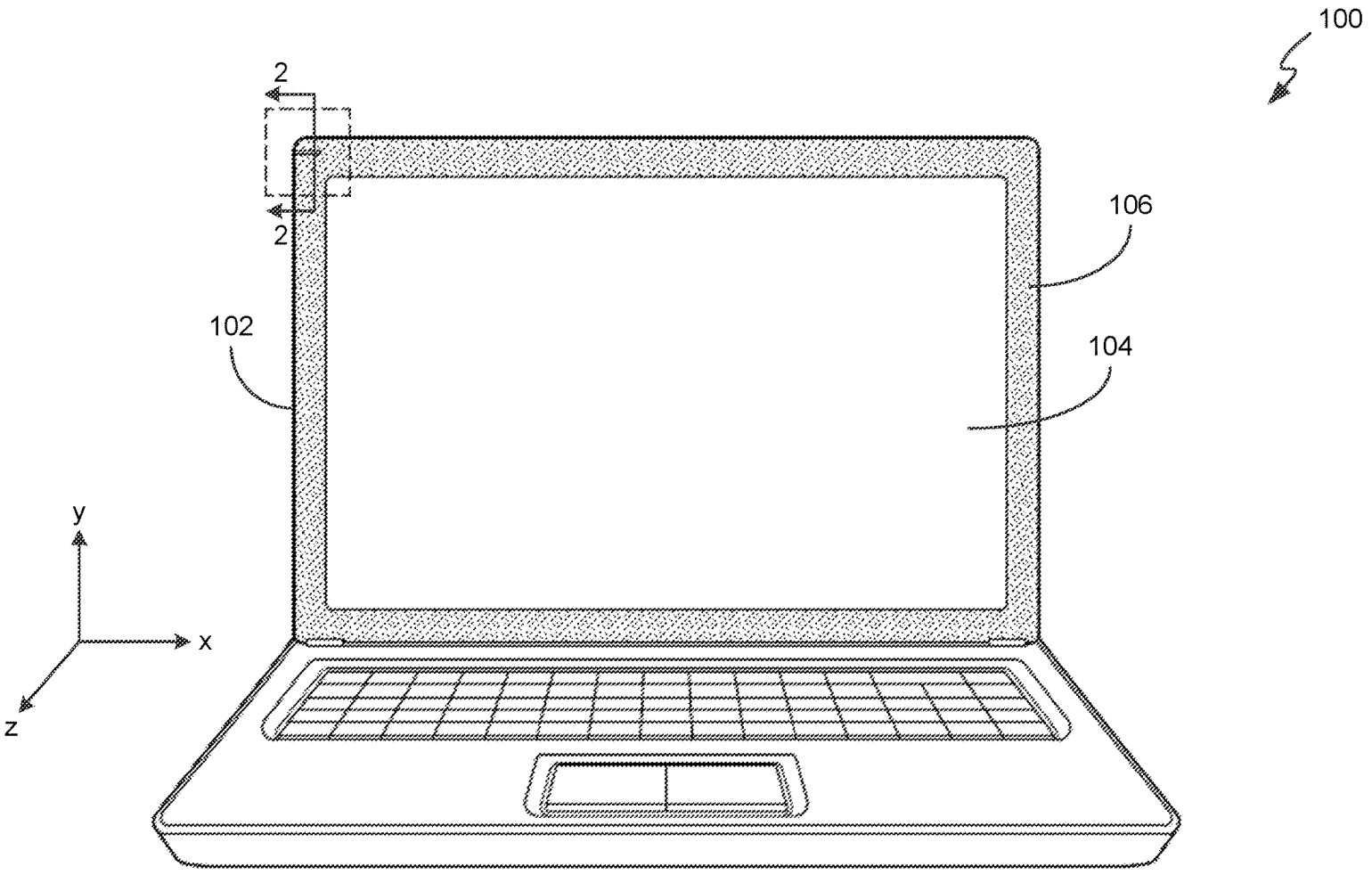
FIG. 1 is a schematic diagram of an example embodiment of a mobile device.

Having summarized various aspects of the present disclosure, reference will now be made in detail to that which is illustrated in the drawings. While the disclosure will be described in connection with these drawings, there is no intent to limit the scope of legal protection to the embodiments disclosed herein. Rather, the intent is to cover all alternatives, modifications and equivalents included within the scope of the disclosure as defined by the appended claims.

In this regard, mobile devices with integrated slot antennas are provided. In some embodiments, such a mobile device incorporates an antenna structure that is configured to form first and second slot antennas by coupling with first and second slots formed in an exterior housing of the mobile device. In some embodiments, a first of the slots is formed in a back of the housing and a second of the slots is formed in a front of the housing so that the slots are on opposite sides of the antenna structure. So configured, the mobile device may exhibit improved operating characteristics compared to a similar device that only incorporates one slot antenna. In some embodiments, the mobile device may exhibit enhanced operating frequencies and radiation efficiency.

FIG. 1 is a schematic diagram of an example embodiment of a mobile device. As shown in FIG. 1, mobile device 100 (which is configured as a laptop computer) incorporates an exterior housing 102 and a display 104 (e.g., a touchscreen display) mounted to the housing. Display 104 is configured to display images at a front 106 of the housing. Although not shown in FIG. 1, mobile device 100 may further include other elements, such as a processor (i.e., processing circuitry), a speaker, and a battery module, among various others. Additionally, although depicted as a laptop in FIG. 1, the teachings presented herein are applicable to other configurations of mobile devices, such as, but not limited to, mobile phones and tablet computers.

Figure 2:
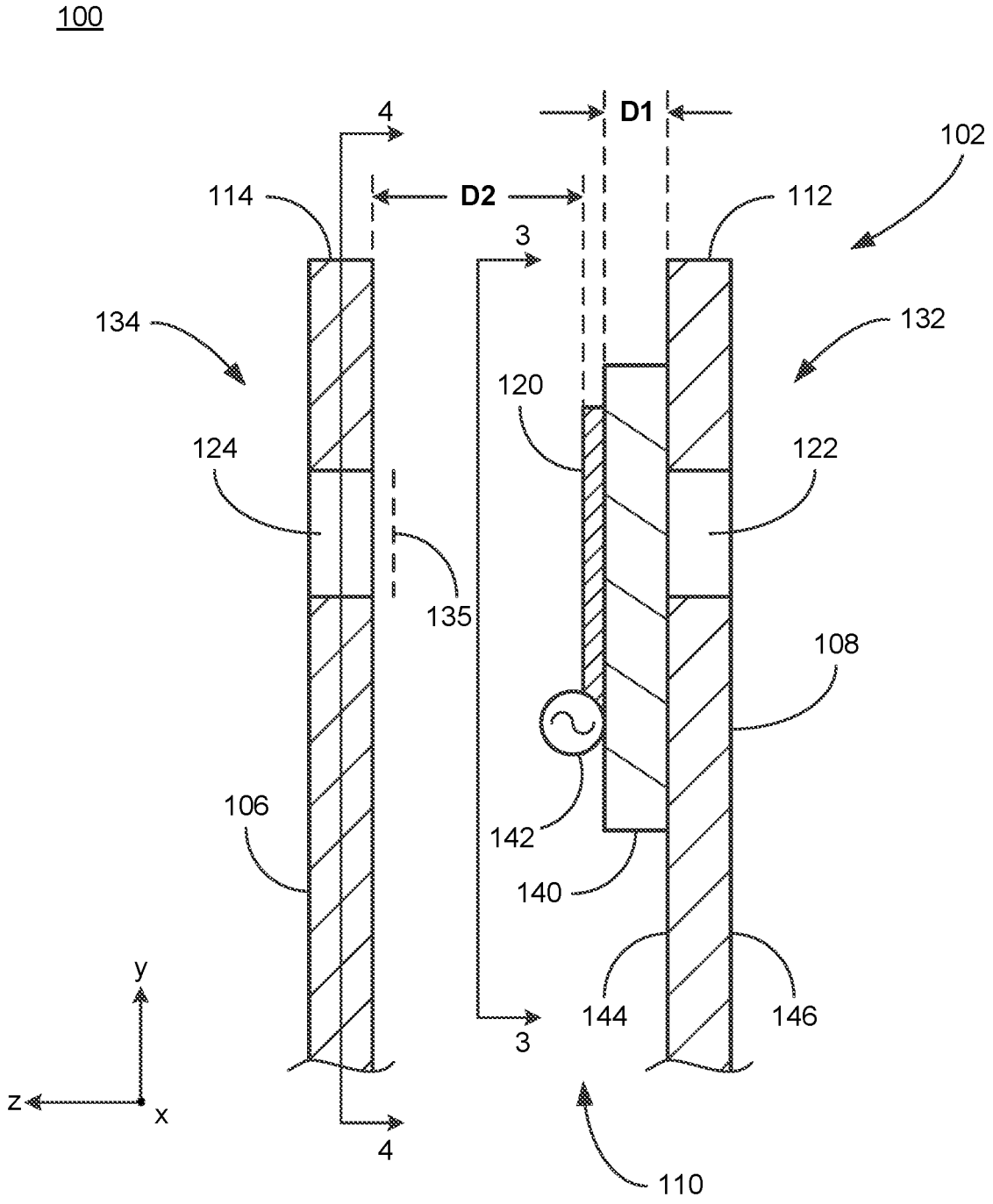
FIG. 2 is a schematic, cross-sectional view of the embodiment of FIG. 1 as viewed along section line 2-2.

As shown in FIG. 2, housing 102 includes a front 106 and an opposing back 108. Housing 102 also defines an interior 110, in which an antenna structure 120 is positioned. Housing 102 incorporates a first portion 112 and a second portion 114, each of which is formed of metal. Specifically, first portion 112 is located at the back 108 of the housing and, in some embodiments, constitutes a corner portion of a metal back cover (e.g., a cover case). First portion 112 also defines a first slot 122 that is configured so that antenna structure 120 and first slot 122 may form a first slot antenna 132. Additionally, second portion 114 is located at the front 106 of the housing and, in some embodiments, constitutes a corner portion of a metal display frame (e.g., a generally hollow rectangular frame) used to mount display 104. Second portion 114 defines a second slot 124 that is configured so that antenna structure 120 and second slot 124 may form a second slot antenna 134. It should be noted that the first slot 122 and the second slot 124 reside in respective planes that are oriented parallel to each other. In this embodiment, each of the slots resides in a plane that is parallel to the x-y axes. As such, when viewed along a viewing line orthogonal to the planes (i.e., along a line parallel to the z-axis), the first slot 122 at least partially overlaps the second slot 124. Stated differently, the vertical projection 135 of first slot 122 at least partially overlaps with second slot 124. This relationship will be described in greater detail with respect to FIGS. 3-5.

In the embodiment of FIG. 2, a dielectric substrate 140 is provided within interior 110, with antenna structure 120 and a signal source 142 for feeding the antenna structure being mounted to dielectric substrate 140. In particular, first portion 112 of the housing includes an inner surface 144 and an outer surface 146, with dielectric substrate 140 being mounted to inner surface 144 so that dielectric substrate 140 covers at least a portion of first slot 122. As such, in this embodiment, dielectric substrate 140 is disposed between first portion 112 and second portion 114 of the housing, with the first portion, the second portion and the dielectric substrate being substantially parallel to each other. It should be noted that dielectric substrate 140 may be provided in various configurations, such as a Flame Retardant 4 (FR4) substrate, a printed circuit board (PCB), or a flexible printed circuit board (FPCB), for example.

In operation, both the first slot 122 and the second slot 124 are simultaneously activated by the antenna structure 140 to enhance the radiation of the antenna structure as compared to a similar device in which only one slot is provided. So configured, the antenna structure 140 is not inhibited by a shielding effect owing to the presence of the housing. Of particular interest, the configuration may permit coverage of both a low frequency band (e.g., a frequency band to which the first slot antenna 132 is tuned) and a high frequency band (e.g., a frequency band to which the second slot antenna 134 is tuned). For example, the low frequency band may be between about 2400 MHz and 2500 MHz, and the high frequency band may be between about 5150 MHz and 5850 MHz, so that the mobile device may support at least WLAN (Wireless Local Area Network) 2.4 GHz/5 GHz band operation.

In some embodiments, dielectric substrate 140 is bonded to inner surface 144, but is separated from the second portion 114 of the housing. In some embodiments, a distance (D2) between the antenna structure 120 and the second portion 114 (e.g., the display frame) is longer than the distance (D1) between the antenna structure and the first portion (e.g., the back cover). In some embodiments, the length ratio (D2:D1) may be between approximately 20:1 and approximately 15:1, in order to adjust the impedance matching and the conformational design characteristics. For example, the distance D2 may be about 5 mm, and the distance D1 may be about 0.3 mm.

Figure 3:
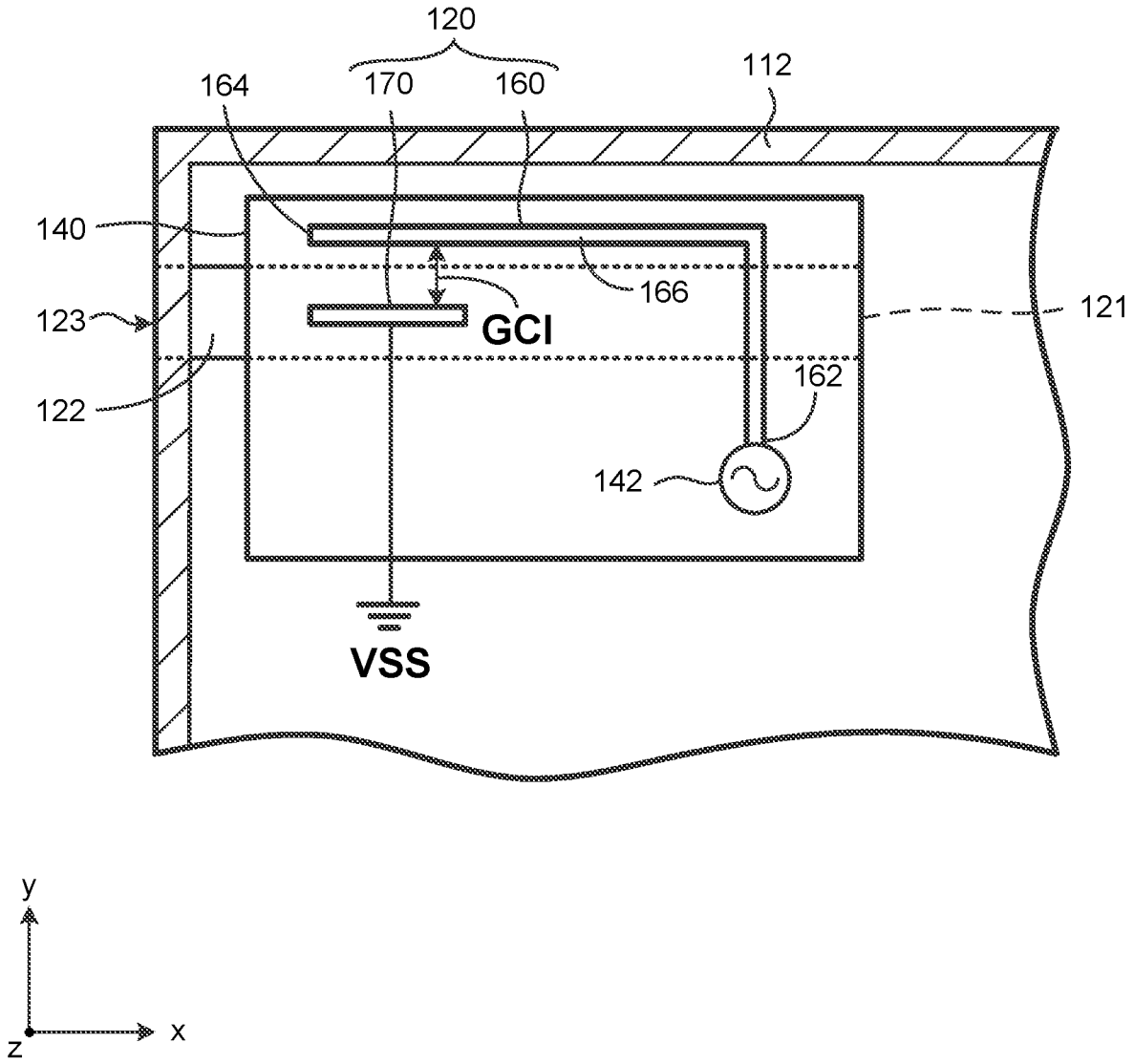
FIG. 3 is a schematic diagram of the embodiment of FIG. 2 as viewed along section line 3-3.
Figure 4:
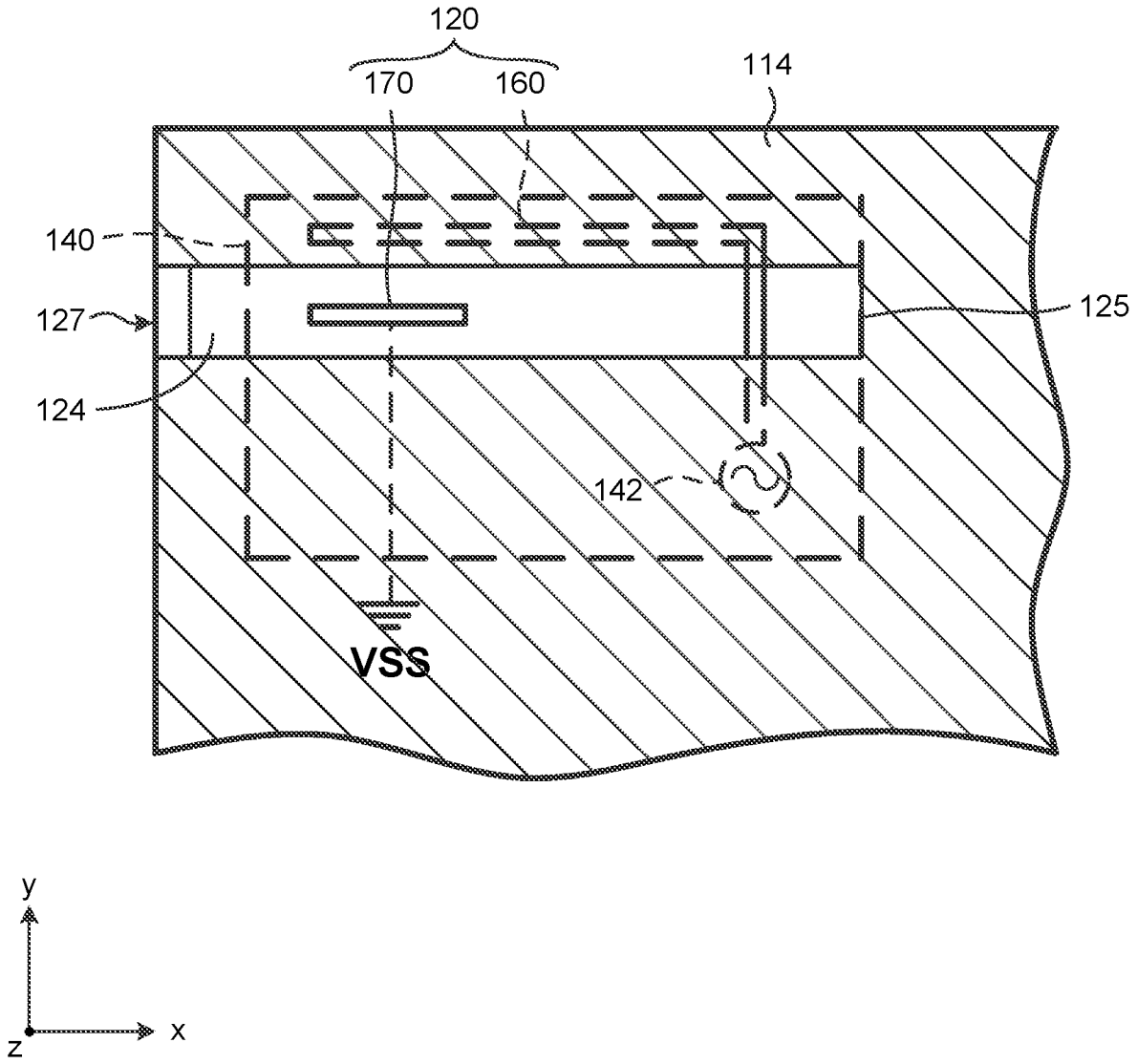
FIG. 4 is a schematic diagram of the embodiment of FIG. 2 as viewed along section line 4-4.

With reference to FIGS. 3 and 4, the antenna structure 120 of the embodiment of FIG. 2 will be described in greater detail. As shown, antenna structure 120 incorporates a feed radiation branch 160 that extends between a proximal end 162 and a distal end 164. Proximal end 162 is coupled to signal source 142. A distal portion 166 of the feed radiation branch, which includes distal end 164, is oriented parallel to an extension direction of the first slot 122. In particular, both distal portion 166 and first slot 122 extend generally parallel to the x-axis; a direction of extension which also may be exhibited by the second slot 124 in some embodiments. In some embodiments, the feed radiation branch extends between the proximal end and the distal end to a length of approximately one quarter of a wavelength (λ/4) associated with the first frequency band.

Antenna structure 120 also incorporates an optional parasitic radiation branch 170 that is coupled to ground (VSS). Parasitic radiation branch 170 is oriented generally parallel to distal portion 166 of feed radiation branch 160 and thus extends in a direction generally parallel to the x-axis. Parasitic radiation branch 170 is separated from distal portion 166 of the feed radiation branch by a coupling gap (GC1). In this embodiment, parasitic radiation branch 170 extends approximately one quarter of a wavelength (λ/4) associated with the second frequency band. It should be noted that although depicted in the embodiment of FIGS. 2-4 as being of a stripe configuration, the feed radiation branch 160 and parasitic radiation branch 170 may exhibit independent shapes and/or take on different configurations (e.g., C-shaped, U-shaped, or a T-shape, for example) in other embodiments.

Figure 5:
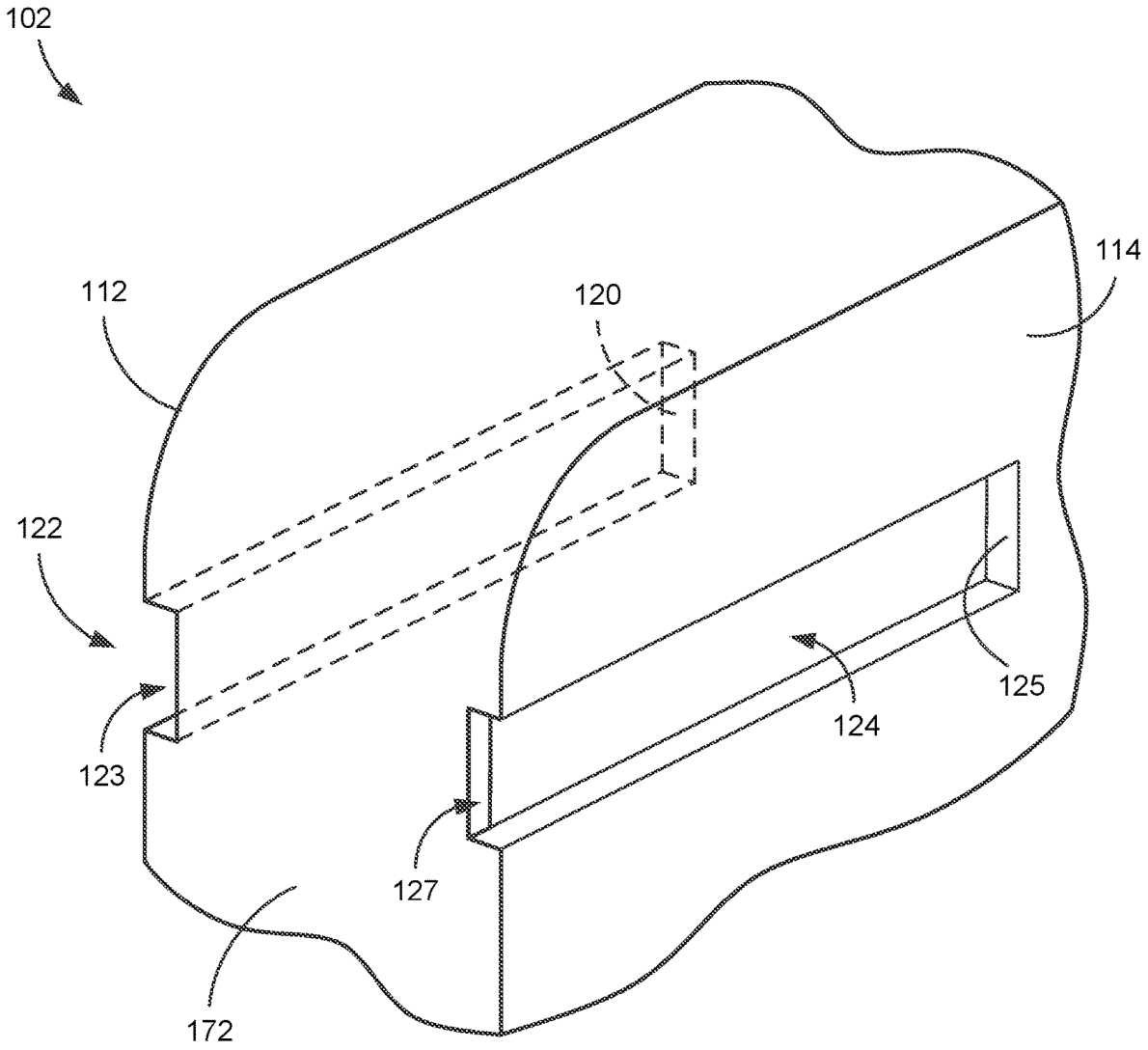
FIG. 5 is a schematic diagram of the embodiment of FIG. 1.

With reference to FIGS. 3-5, the first and second slots will be described in greater detail. As shown, first slot 122 extends between a closed first end 121 and an open second end 123, and second slot 124 extends between a closed third end 125 and an open fourth end 127. Notably, each of the open ends 123, 127 is oriented adjacent an exterior edge 172 of housing 102. It should also be noted that a shape of first slot 122 matches a shape of second slot 124; in this case, each of the slots is rectangular in shape. In this embodiment, first slot 122 extends approximately one quarter of a wavelength (λ/4) associated with the first frequency band, and second slot 124 extends approximately one quarter of a wavelength (λ/4) associated with the second frequency band.

As shown most clearly with respect to FIGS. 2 and 5, first slot 122 and second slot 124 reside in respective planes that are oriented parallel to each other. Thus, when viewed along a viewing line orthogonal to the planes (e.g., along the z-axis), first slot 122 at least partially overlaps second slot 124. Additionally, with further reference to FIGS. 3 and 4, when viewed along such a viewing line in this embodiment, first slot 122 overlies an entirety of parasitic radiation branch 170. So configured, first slot antenna 132 and second slot antenna 134 may generate side-side radiation to improve the communication quality of the mobile device 100. In some embodiments, one of the vertical projections of parasitic radiation branch 170 may lie entirely within second slot 124 to facilitate optimization of the operation band and the impedance matching of the first slot antenna and the second slot antenna.

Figure 6:
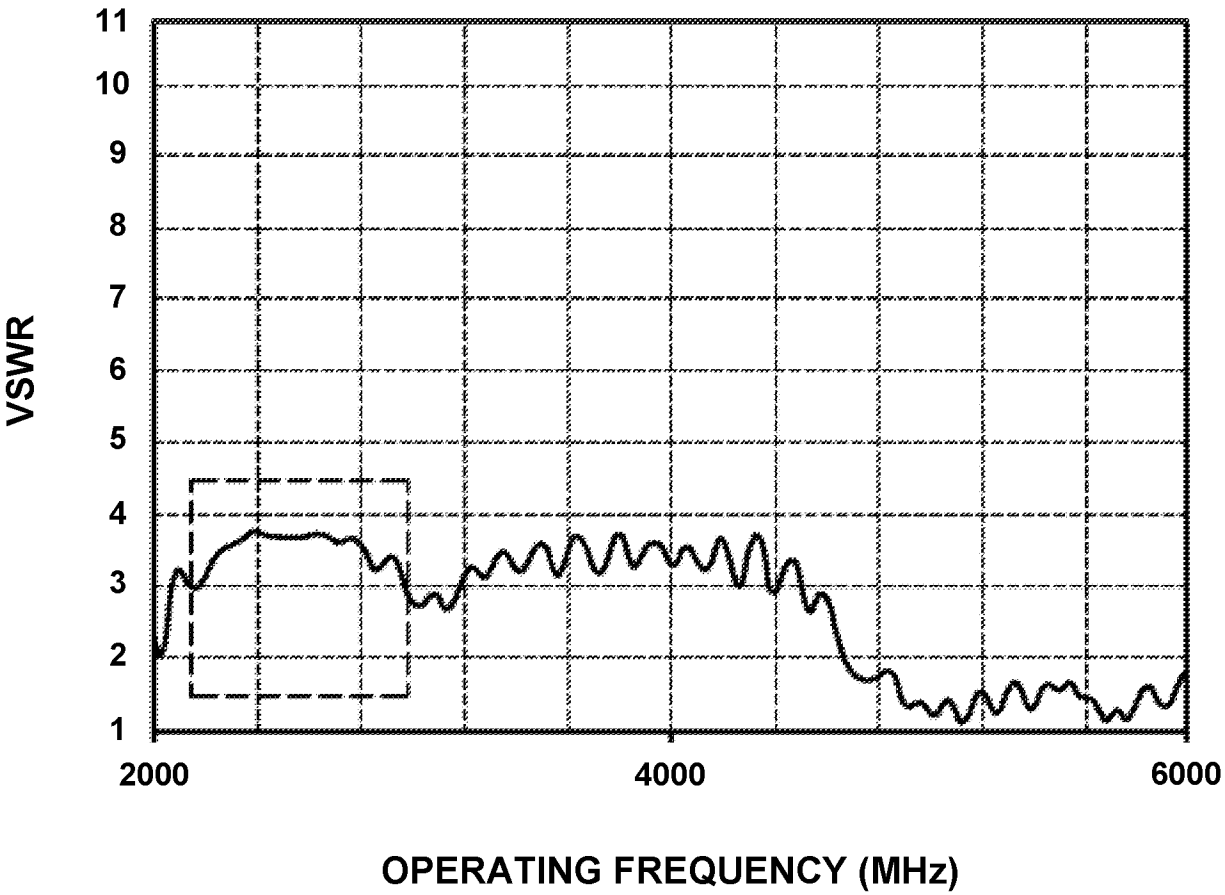
FIG. 6 is a graph depicting the voltage standing wave ratio (VSWR) versus operating frequency (MHz) of a mobile device that lacks a second slot antenna.

FIG. 6 is a graph depicting the voltage standing wave ratio (VSWR) versus operating frequency (MHz) of a mobile device that incorporates a first slot antenna but lacks a second slot antenna arranged in the side-side configuration described previously. As shown in FIG. 6, if only a first slot antenna (e.g., slot antenna 132) is provided and the front of the housing (e.g., the entire display frame) is made of metal, the resonant mode of the associated antenna structure in the low frequency band (e.g., between 2400 MHz and 2500 MHz) may be seriously disturbed.

Figure 7:
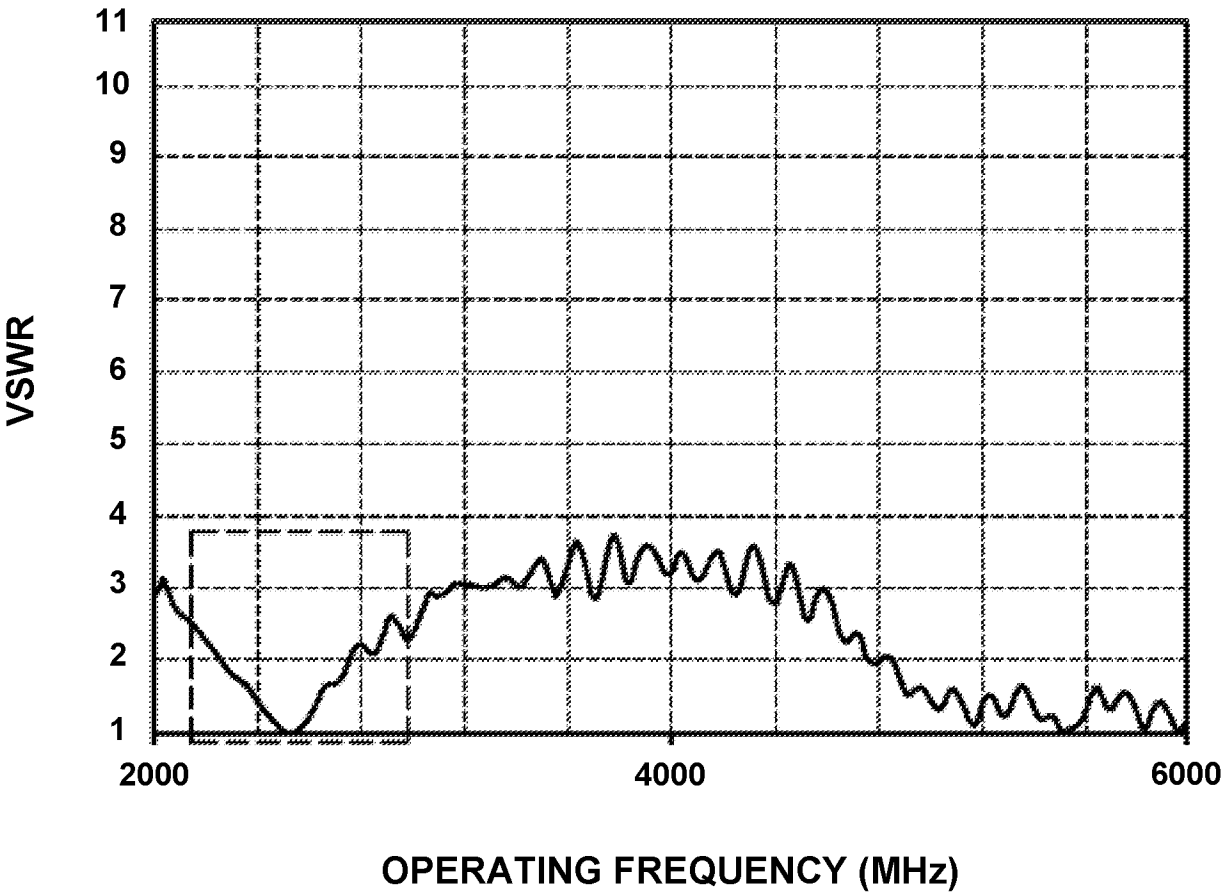
FIG. 7 is a graph depicting the voltage standing wave ratio (VSWR) versus operating frequency (MHz) of a mobile device, similar to the mobile device represented in FIG. 6, but which incorporates a second slot antenna.

FIG. 7 is a graph depicting the voltage standing wave ratio (VSWR) versus operating frequency (MHz) of a mobile device, similar to the mobile device represented in FIG. 6, but which incorporates a second slot antenna. That is, if the mobile device additionally incorporates a second slot (e.g., slot 124) and thus a second slot antenna (e.g., slot antenna 134), the operating characteristics of the antenna structure in the low frequency band can be significantly improved and the low frequency bandwidth can be greatly increased.

Figure 8:
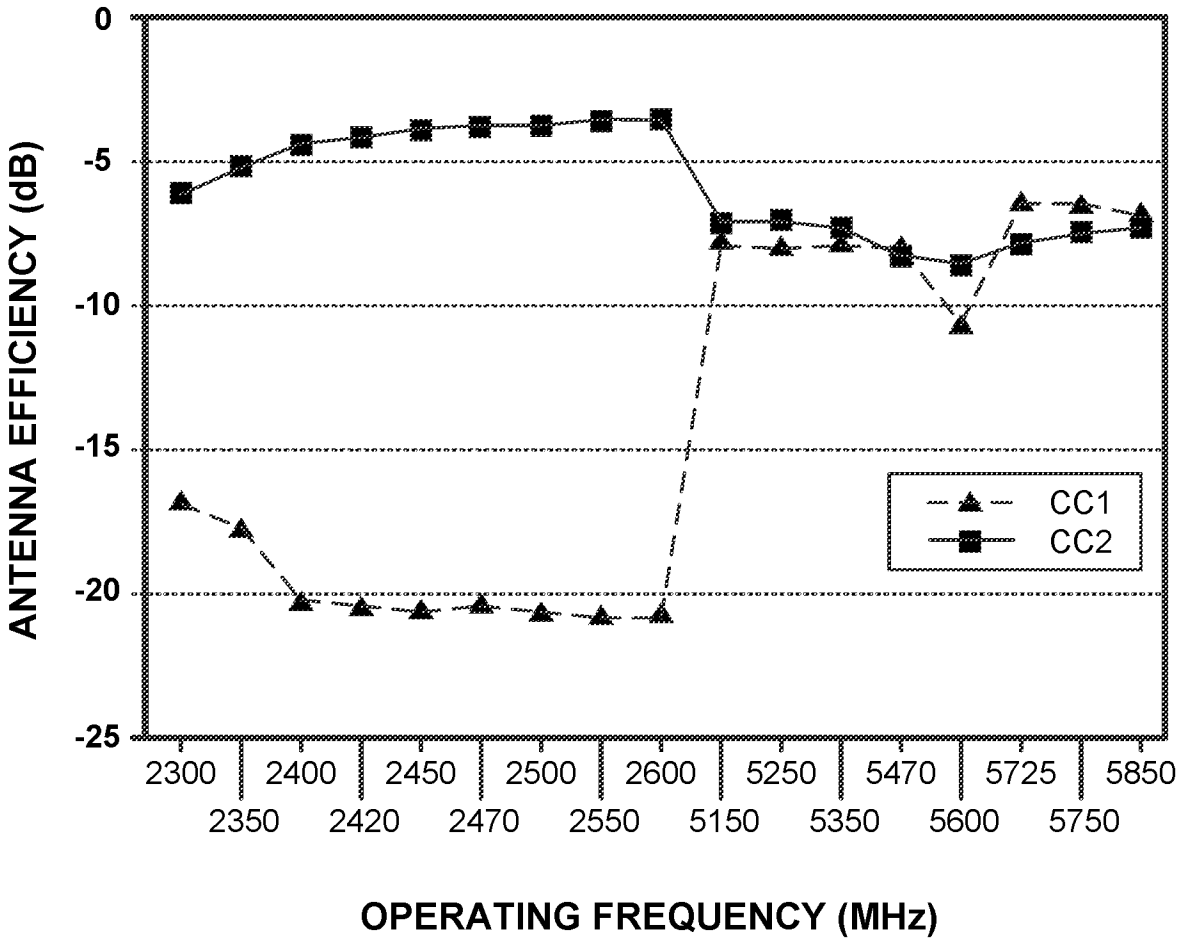
FIG. 8 is a graph depicting the antenna efficiency (dB) versus operating frequency (MHz) of a mobile device (CC1) that lacks a second slot antenna compared to a mobile device (CC2) that incorporates a second slot antenna.

FIG. 8 is a graph depicting the antenna efficiency (dB) versus operating frequency (MHz) of a mobile device (CC1) that lacks a second slot antenna compared to a mobile device (CC2) that incorporates a second slot antenna. According to the measurement results, since the addition of the second slot allows the antenna structure to resonate with the display frame, the radiation efficiency of the antenna structure in the low frequency band can be increased by at least about 1.5 dB.

Figure 9:
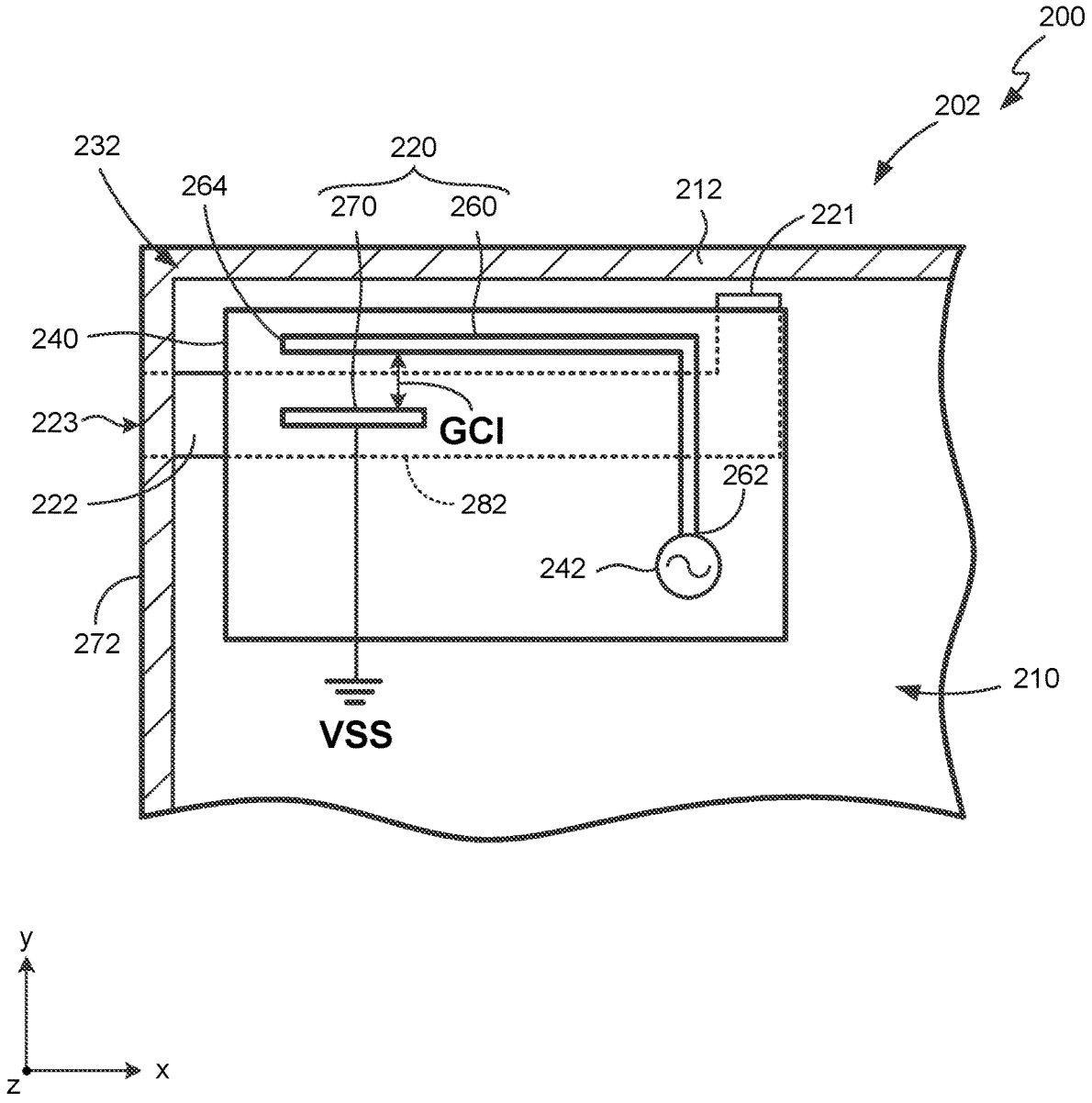
FIGS. 9 and 10 are schematic diagrams of another example embodiment of a mobile device.
Figure 10:
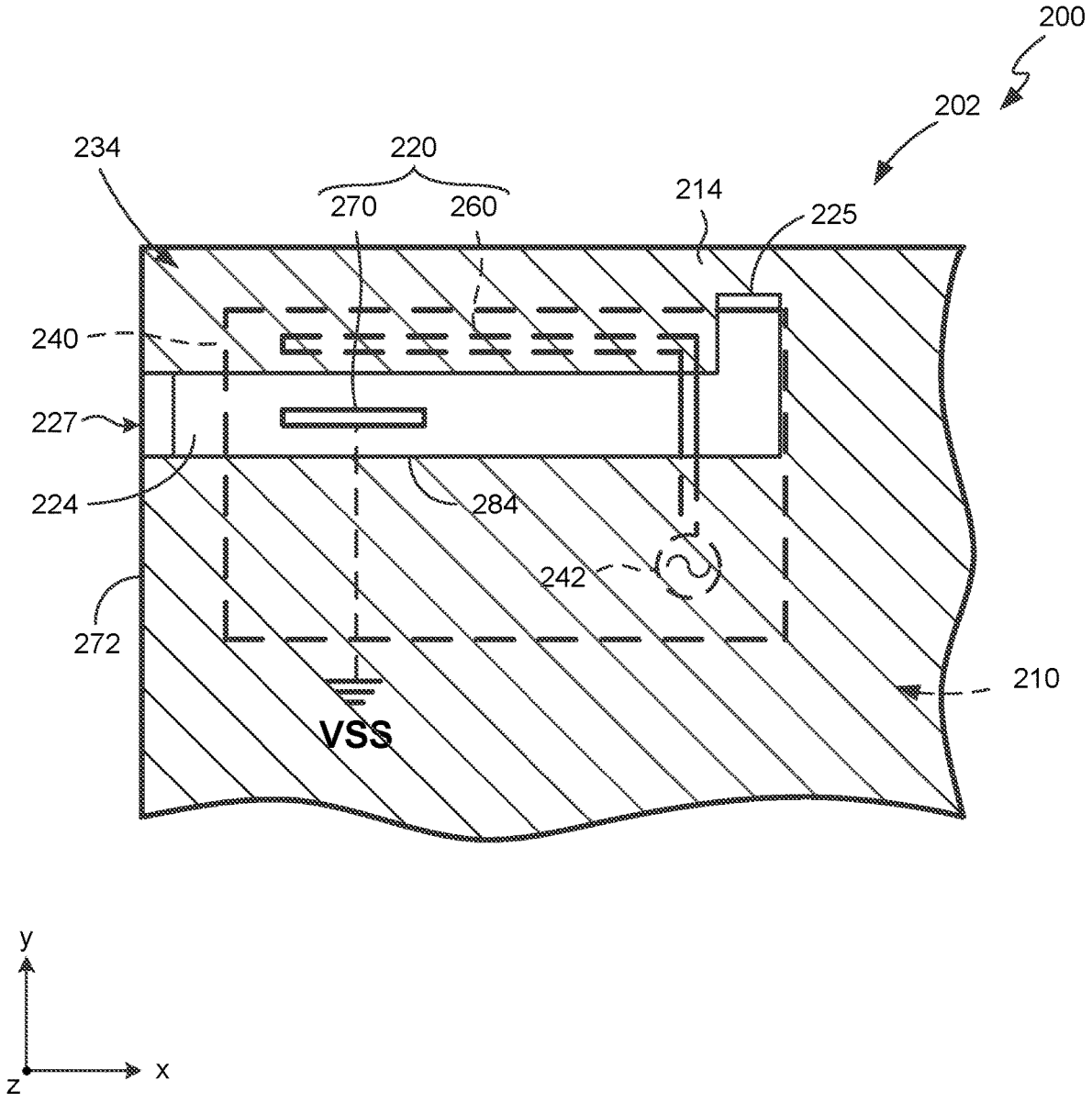

FIGS. 9 and 10 are schematic diagrams of another example embodiment of a mobile device. In particular, FIGS. 9 and 10 are similar to the views provided in FIGS. 3 and 4, which are associated with cross-sections from the embodiment of FIG. 2. Although associated with a different embodiment, FIGS. 9 and 10 are useful in depicting the structural relationships between various features.

As shown, mobile device 200 incorporates a housing 202 that defines an interior 210, in which an antenna structure 220 is positioned. Housing 202 incorporates a first portion 212 and a second portion 214, each of which is formed of metal. Specifically, first portion 212 is located at the back of the housing and, in some embodiments, constitutes a portion of a metal back cover (e.g., a cover case). First portion 212 also defines a first slot 222 that is configured so that antenna structure 220 and first slot 222 may form a first slot antenna 232. Additionally, second portion 214 is located at the front of the housing and, in some embodiments, constitutes a portion of a metal display frame (e.g., a generally hollow rectangular frame) used to mount a display. Second portion 214 defines a second slot 224 that is configured so that antenna structure 220 and second slot 224 may form a second slot antenna 234.

In contrast to the embodiment of FIGS. 2-5, in which the slots are rectangular, first slot 222 and second slot 224 are L-shaped. In particular, first slot 222 extends between a closed first end 221 and an open second end 223, and second slot 224 extends between a closed third end 225 and an open fourth end 227. Notably, each of the open ends 223, 227 is oriented adjacent an exterior edge 272 of housing 202. In this embodiment, antenna structure 220 and a signal source 242 are supported by a dielectric substrate 240. In this embodiment, dielectric substrate 240 extends across respective intermediate portions of the first slot 222 and second slot 224 such that the corresponding ends of the slots extend outwardly beyond the periphery of dielectric substrate 240.

Antenna structure 220 incorporates a feed radiation branch 260 that extends between a proximal end 262 and a distal end 264. Proximal end 262 is coupled to signal source 242. A distal portion 266 of the feed radiation branch, which includes distal end 264, is oriented parallel to an extension direction of an elongated portion 282 of the first slot 222. In particular, both distal portion 266 and the elongated portion 282 extend generally parallel to the x-axis; a direction of extension which also may be exhibited by an elongated portion 284 of second slot 224 in some embodiments.

Antenna structure 220 also incorporates an optional parasitic radiation branch 270 that is coupled to ground (VSS). Parasitic radiation branch 270 is oriented generally parallel to distal portion 266 of feed radiation branch 260 and thus extends in a direction generally parallel to the x-axis. Parasitic radiation branch 270 is separated from distal portion 266 of the feed radiation branch by a coupling gap (GC1).

The above described embodiments potentially offer improvements over conventional designs in which a display frame of notebook computer is typically made of a non-conductive material to avoid interference with an associated antenna structure. In particular, in contrast to traditional designs that, when using a metal back cover, typically incorporate a larger antenna window to maintain the communication quality of the antenna, the integrated slots reduce interference of the antenna structure caused by the metal housing components (e.g., back cover and/or display frames) thereby increasing design flexibility. Notably, the slot sizes may be relatively small, which potentially improve the appearance of the mobile device while mitigating reductions in structural strength due to the incorporation of slots.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A mobile device comprising:

a housing having a front and a back and defining an interior;

a display, mounted to the housing, configured to display images at the front of the housing; and an antenna structure positioned within the interior;

the housing having a first portion and a second portion, each of which is formed of metal, the first portion being located at the back of the housing and defining a first slot such that the antenna structure and the first slot form a first slot antenna, the second portion being located at the front of the housing and defining a second slot such that the antenna structure and the second slot form a second slot antenna, wherein:

the first slot extends between a closed first end and an open second end;

the second slot extends between a closed third end and an open fourth end; and each of the second end and the fourth end is oriented adjacent an exterior edge of the housing.

2. The mobile device of claim 1, wherein:

the mobile device further comprises a signal source positioned within the interior;

the antenna structure has a feed radiation branch extending between a proximal end, coupled to the signal source, and a distal end; and a distal portion of the feed radiation branch, including the distal end, is oriented parallel to an extension direction of the first slot.

3. The mobile device of claim 2, wherein the distal portion of the feed radiation branch is oriented parallel to an extension direction of the second slot.

4. The mobile device of claim 2, wherein:

the antenna structure further comprises a parasitic radiation branch coupled to ground; and the parasitic radiation branch is separated from the feed radiation branch by a coupling gap.

5. The mobile device of claim 4, wherein the parasitic radiation branch is oriented parallel to the distal portion of the feed radiation branch.

6. The mobile device of claim 4, wherein:

the first slot resides in a plane; and when viewed along a viewing line orthogonal to the plane, the first slot overlies an entirety of the parasitic radiation branch.

7. The mobile device of claim 1, wherein:

the first slot and the second slot reside in respective planes that are oriented parallel to each other; and when viewed along a viewing line orthogonal to the planes, the first slot at least partially overlaps the second slot.

8. The mobile device of claim 1, wherein:

the mobile device further comprises a dielectric substrate positioned within the interior; and the antenna structure is mounted to the dielectric substrate.

9. The mobile device of claim 8, wherein:

the housing comprises a back cover formed of metal, the back cover including the first portion and having an inner surface and an outer surface; and the dielectric substrate is mounted to the inner surface of the back cover.

10. The mobile device of claim 1, wherein the housing comprises a display frame formed of metal, the display frame including the second portion.

11. The mobile device of claim 10, wherein:

the housing comprises a back cover formed of metal, the back cover including the first portion; and a distance (D2) between the antenna structure and the display frame is longer than a distance (D1) between the antenna structure and the back cover.

12. The mobile device of claim 11, wherein a length ratio (D2:D1) is between approximately 20:1 and approximately 15:1.

13. The mobile device of claim 1, wherein the first slot antenna is tuned to a first frequency band and the second slot antenna is tuned to a second frequency range different from the first frequency band.

14. The mobile device of claim 13, wherein:

the mobile device further comprises a signal source positioned within the interior;

the antenna structure has a feed radiation branch extending between a proximal end, coupled to the signal source, and a distal end; and the feed radiation branch extends approximately one quarter of a wavelength ($\lambda/4$) associated with the first frequency band between the proximal end and the distal end.

15. The mobile device of claim 14, wherein:

the antenna structure further comprises a parasitic radiation branch, separated from the feed radiation branch, coupled to ground; and the parasitic radiation branch extends approximately one quarter of a wavelength ($\lambda/4$) associated with the second frequency band.

16. The mobile device of claim 15, wherein:

the first frequency band is in a range of between approximately 2400 MHz and 2500 MHz; and the second frequency band is in a range of between approximately 5150 MHz and 5850 MHz.

17. The mobile device of claim 13, wherein:

the first slot extends approximately one quarter of a wavelength ($\lambda/4$) associated with the first frequency band between a first end and a second end; and the second slot extends approximately one quarter of a wavelength ($\lambda/4$) associated with the second frequency band between a third end and a fourth end.

18. The mobile device of claim 1, wherein a shape of the first slot matches a shape of the second slot.

19. The mobile device of claim 1, wherein each of the first slot and the second slot is rectangular.

20. A mobile device comprising:

a housing having a front and a back and defining an interior;

a display, mounted to the housing, configured to display images at the front of the housing;

an antenna structure positioned within the interior and having a parasitic radiation branch coupled to ground; and a signal source positioned within the interior;

the housing having a first portion and a second portion, each of which is formed of metal, the first portion being located at the back of the housing and defining a first slot such that the antenna structure and the first slot form a first slot antenna, the second portion being located at the front of the housing and defining a second slot such that the antenna structure and the second slot form a second slot antenna, wherein:

the antenna structure has a feed radiation branch extending between a proximal end, coupled to the signal source, and a distal end;

a distal portion of the feed radiation branch, including the distal end, is oriented parallel to an extension direction of the first slot; and the parasitic radiation branch is separated from the feed radiation branch by a coupling gap.

21. A mobile device comprising:

a housing having a front and a back and defining an interior;

a display, mounted to the housing, configured to display images at the front of the housing;

an antenna structure positioned within the interior; and a signal source positioned within the interior;

the housing having a first portion and a second portion, each of which is formed of metal, the first portion being located at the back of the housing and defining a first slot such that the antenna structure and the first slot form a first slot antenna, the second portion being located at the front of the housing and defining a second slot such that the antenna structure and the second slot form a second slot antenna, wherein the first slot antenna is tuned to a first frequency band and the second slot antenna is tuned to a second frequency range different from the first frequency band, wherein:

the antenna structure has a feed radiation branch extending between a proximal end, coupled to the signal source, and a distal end; and the feed radiation branch extends approximately one quarter of a wavelength ($\lambda/4$) associated with the first frequency band between the proximal end and the distal end.

* * * * *